US005080234A

United States Patent [19]

Benson

[11] Patent Number: 5,080,234

[45] Date of Patent: Jan. 14, 1992

[54] EDDY CURRENT SEPARATOR

[75] Inventor: William H. Benson, Erie, Pa.

[73] Assignee: Walker Magnetics Group, Inc., Worcester, Mass.

[21] Appl. No.: 568,271

[22] Filed: Aug. 15, 1990

[51] Int. Cl.[5] ..... B03C 1/24

[52] U.S. Cl. ..... 209/212; 209/219

[58] Field of Search ..... 209/212, 219, 214, 215, 209/225; 210/222, 223

[56] References Cited

U.S. PATENT DOCUMENTS

| | | | |
|---|---|---|---|
| 2,745,549 | 8/1954 | Spodig | 209/219 |
| 3,394,807 | 12/1965 | Fritz et al. | 209/219 |
| 3,448,857 | 6/1969 | Benson et al. | 209/212 |
| 4,106,627 | 8/1978 | Watanabe et al. | 209/212 X |
| 4,296,865 | 10/1981 | Spodig | 209/219 X |
| 4,459,206 | 7/1984 | Laithwaite | 209/3 |
| 4,743,364 | 5/1988 | Kyrazis | 209/212 |
| 4,834,870 | 5/1989 | Osterberg et al. | 209/212 X |

FOREIGN PATENT DOCUMENTS

| | | | |
|---|---|---|---|
| 74397 | of 1888 | United Kingdom | 209/219 |
| 342330 | 11/1989 | European Pat. Off. | 209/219 |
| 5269 | 1/1979 | Japan | 209/219 |

*Primary Examiner*—Donald T. Hajec
*Attorney, Agent, or Firm*—Henry D. Pahl, Jr.

[57] ABSTRACT

The eddy current separator apparatus disclosed herein employs first and second cylinders, each of which is provided with means for generating a circumferential series of radially directed magnetic poles of alternating polarity. The cylinders are mounted for rotation around parallel axes with an essentially vertical gap between them. A mixture of electrically conductive and non-conductive particles can be fed into the gap from one side. The cylinders are rotated synchronously in opposite directions with poles of opposite polarity facing across the gap, at a speed substantially higher than the speed of mixture feed. Electrically conductive non-magnetic particles are impelled by eddy currents generated by the magnetic flux projected across the gap by the faacing moving poles and can be received or collected separately from free falling non-conductive particles.

7 Claims, 1 Drawing Sheet

EDDY CURRENT SEPARATOR

BACKGROUND OF THE INVENTION

The present invention relates to eddy current separators and more particularly to such separators in which conductive particles are impelled by eddy currents generated by magnetic flux projected across the gap by rotating magnetic poles. The present invention is an improvement on the apparatus disclosed and claimed in my earlier U.S. Letters Pat. No. 3,448,857.

As distinct from magnetic separation, eddy current separation can be effective with conductive materials or particles which are not magnetic in character. Whereas magnetic separators typically operate by attracting the pieces to be separated out from a mixture, eddy current separators operate by sweeping magnetic flux through the mixture so that eddy currents are developed in any conductive particles in the mixture and these particles are subject to a resultant force. The magnitude of the resultant force is dependent on electrical resistivity, size and shape of the conductive particle, magnetic field flux strength and the velocity and frequency of the rotating magnetic poles. Thus, while similar constituent elements may be employed in separators of the two types, their actual modes of operation and the relative orientations of the elements are substantially different. A typical application for an eddy current separator in accordance with the present invention is separating aluminum cap pieces from shredded plastic bottles which are to be recycled.

Among the several objects of the present invention may be noted the provision of novel apparatus for separating conductive particles from non-conductive particles; the provision of such apparatus which is highly selective in separating conductive from non-conductive materials; the provision of such apparatus which is highly reliable and which is of relatively simple and inexpensive construction. Other objects and features will be in part apparent and in part pointed out hereinafter.

SUMMARY OF THE INVENTION

Separator apparatus constructed in accordance with the present invention employs first and second cylinders, each of which is provided with means for generating a circumferential series of radially directed magnetic poles of alternating polarity. The cylinders are mounted for rotation around parallel axes with a substantially vertical gap therebetween. A mixture of conductive and non-conductive particles can be fed into the gap from one side. The cylinders are rotated synchronously in opposite directions with poles of opposite polarity facing across the gap, at a speed substantially higher than the speed of mixture feed. On the other side of the gap, means are provided for separately receiving conductive particles which are impelled by eddy currents generated by magnetic flux projected across the gap by the facing moving poles, apart from free falling non-conductive particles.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
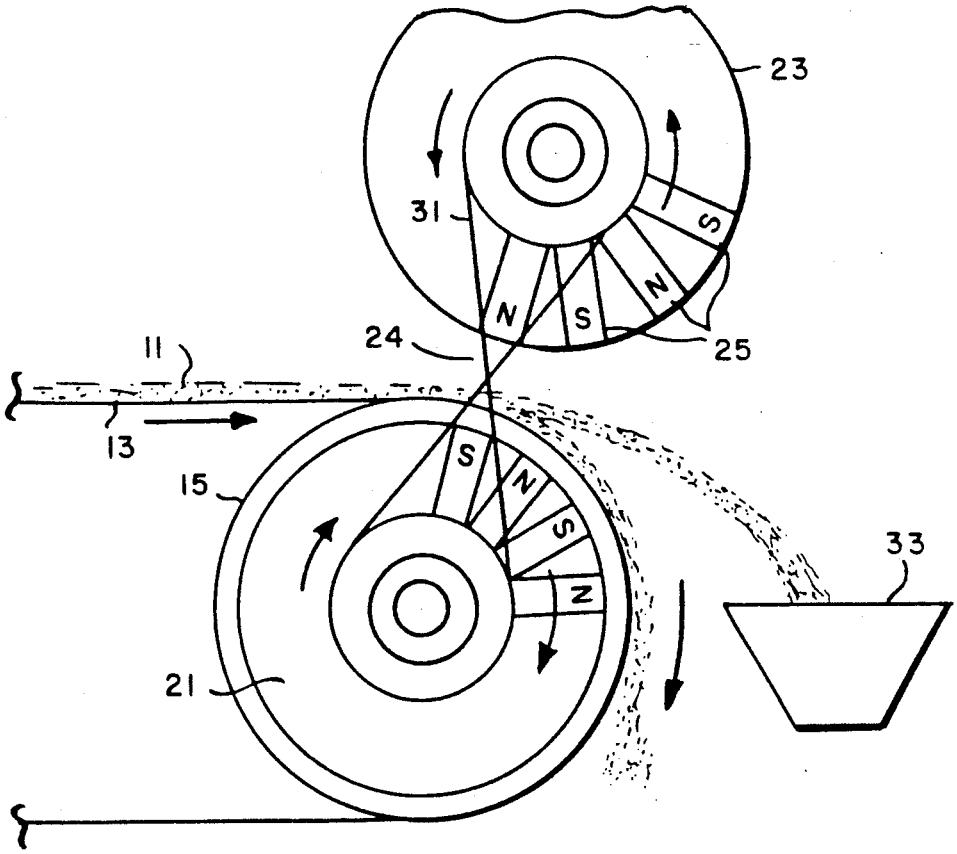
FIG. 1 is a diagrammatic illustration of eddy current separator apparatus constructed in accordance with the present invention.

Referring now to FIG. 1, a mixture of conductive and non-conductive particles, designated generally by reference character 11, is brought into the apparatus by means of a conveyor belt 13 which passes over a hollow drum 15 journaled for free rotation. The drum is preferably constructed of a non-conductive or high resistivity material. The mixture is fed in at a relatively slow rate, e.g. a few feet per second, so that, in the absence of any selecting force, incoming material is merely dumped off the end of the conveyor. A vibratory feeder might also be used.

Journaled for rotation within the drum 15 is a first magnetic cylinder 21. Journaled on a parallel axis above the belt 13 is second magnetic cylinder 23. A substantially vertical gap 24 is provided between the two magnetic cylinders 21 and 23, the mixture 11 being fed into this gap. Each of the cylinders 21 and 23 incorporates a plurality of bar-like permanent magnets 25 which extend the length of the respective cylinder and which are magnetized in a direction which is radial with respect to the cylinder axis. Alternating magnets in each cylinder are oppositely polarized so that each cylinder provides a circumferential series of radially directed magnetic poles of alternating polarity.

While magnetic attraction itself between the two cylinders will tend to orient them with poles of opposite polarity facing across the gap, it is presently preferred that this orientation be enforced by gearing between the cylinders or by the use of a figure eight timing belt as indicated at 31. In operation, the cylinders are driven into rotation at a speed providing a velocity at the periphery of each cylinder which is substantially higher than the speed of mixture feed, e.g. 2400 rpm for an eight inch diameter cylinder. The timing belt 31 causes the two cylinders to rotate synchronously in opposite directions with poles of opposite polarity facing across the gap.

The rotation of the cylinders in this fashion causes bands of intense flux to be swept through the incoming mixture. Since the flux path extends essentially directly across the gap, the movement of each flux band, from left to right as illustrated, will cause eddy currents to be generated in any conductive particles in the mixture. As is understood, these eddy currents set up their own magnetic fields, which in accordance with Lenz's law, always oppose the magnetic field changes. Accordingly, the conductive particles will be forcefully impelled by the eddy currents and will tend to be swept along by the bands of magnetic flux which are moving at relatively high speed. Accordingly, conductive particles will tend to be projected out and beyond the path of free falling non-conductive particles and thus may be separately collected, e.g. in a bin, as indicated at reference character 33. Separate conveyors for removing the separated components of the mixture might also be utilized.

As compared with the construction shown in my earlier U.S. Pat. No. 3,448,857, the present invention provides not only a stronger magnetic flux because of the use of two magnetic cylinders but the desired separating action is greatly enhanced for the reason that the flux paths extend quite directly across the gap 24 rather than arching between opposite poles on the same cylinder so that much of the flux path lies parallel to the direction of mixture feed and is thus relatively ineffective in inducing eddy currents.

Figure 2:
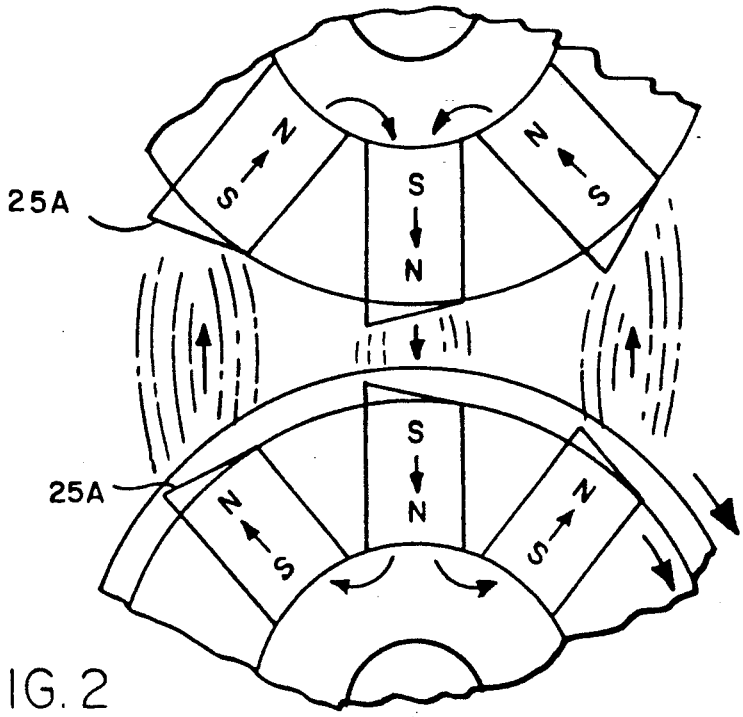
FIG. 2 is an illustration, to enlarged scale, showing a pole configuration for concentrating flux in the apparatus of FIG. 1.

As is understood by those skilled in the art, the generation of eddy currents in a conductive particle is a function of the rate of change of magnetic flux linking possible current paths or loops within the particle. To establish a more concentrated flux band which is swept through the mixture, a pointed or beveled pole configuration can be utilized as illustrated in FIG. 2. In this embodiment, the pole pieces are inclined, as illustrated at reference character 25A, so that the flux builds up and concentrates towards the trailing edge of each pole piece.

While it is presently preferred to utilize permanent magnets for generating the radially directed magnetic poles of alternating polarity, it will be understood by those skilled in the art that such a configuration of rotating magnetic poles could also be provided by energizing suitably phased windings with polyphase current.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. Separator apparatus comprising:

first and second cylinders, each of which is provided with means for generating a circumferential series of radially directed elongated magnetic poles of alternating polarity, each of the poles extending the axial length of the respective cylinder;

means for mounting said cylinders for rotation around parallel axes with a substantially vertical gap therebetween;

means for feeding a mixture of electrically conductive and non-conductive particles into said gap from one side;

means for rotating said cylinders synchronously in opposite directions with poles of opposite polarity facing across said gap, at a speed substantially higher than the speed of mixture feed; and on the other side of said gap, means for receiving particles passing through said gap, said receiving means including means for separately receiving conductive particles which are impelled by eddy currents generated by magnetic flux projected across said gap by facing moving poles, apart from free falling non-conductive particles.

2. Apparatus as set forth in claim 1 further comprising means positively coupling said first and second cylinders for synchronous rotation in opposite directions.

3. Apparatus as set forth in claim 2 wherein said coupling means comprises a timing belt.

4. Apparatus as set forth in claim 2 wherein said coupling means comprises gearing.

5. Apparatus as set forth in claim 1 wherein said feeding means comprises a conveyor belt.

6. Apparatus as set forth in claim 5 wherein said conveyor belt passes over a drum journaled for rotation around one of said magnetic cylinders.

7. Separator apparatus comprising:

first and second cylinders, each of which is provided with a series of permanent magnets for generating a circumferential series of radially directed elongate magnetic poles of alternating polarity, each of the poles extending the axial length of the respective cylinder;

means for mounting said cylinders for rotation around parallel axes with a substantially vertical gap therebetween;

a drum journaled for rotation around the lower one of said cylinders;

a conveyor belt passing over said drum for feeding a mixture of conductive and non-conductive particles into said gap from one side;

means for rotating said cylinders synchronously in opposite directions with poles of opposite polarity facing across said gap, at a speed substantially higher than the speed of mixture feed; and on the other side of said gap, means for receiving particles passing through said gap, said receiving means including means for separately receiving conductive particles which are impelled by eddy currents generated by magnetic flux projected across said gap by facing moving poles, apart from fee falling non-conductive particles.

* * * * *